United States Patent [19]

Togneri

[11] 4,254,412

[45] Mar. 3, 1981

[54] CONTROLLER DEVIATION INDICATOR

[75] Inventor: Mauro G. Togneri, Houston, Tex.

[73] Assignee: Powell Industries, Inc., Houston, Tex.

[21] Appl. No.: 47,710

[22] Filed: Jun. 12, 1979

[51] Int. Cl.[3] ..... G08B 19/00

[52] U.S. Cl. ..... 340/525; 340/506; 340/517; 340/521

[58] Field of Search ..... 340/500, 506, 511, 517, 340/521, 524, 525, 366 R, 366 A

[56] References Cited

U.S. PATENT DOCUMENTS

| | | | |
|---|---|---|---|
| 3,623,087 | 11/1971 | Gallichotte | 340/525 |
| 3,940,739 | 2/1976 | Quimet | 340/525 |
| 4,115,754 | 9/1978 | Duzich | 340/525 |

*Primary Examiner*—Alvin H. Waring
*Attorney, Agent, or Firm*—David M. Ostfeld

[57] ABSTRACT

A deviation indicator interface for simultaneously providing an indication of the deviation of the process value from the set point for each loop of a multi-loop controller is disclosed. The deviation indicator interface includes a plurality of deviation indicators, each deviation indicator providing an indication of the loop deviation of a single loop. Each deviation indicator includes a first, second and third indicator portion. The first indicator portion produces a visible signal whenever the loop process value exceeds the loop set point by at least a first amount, the first amount being adjustable. The second indicator portion produces a visible signal whenever the loop process value is less than the loop set point by at least a second amount, the second amount being adjustable. The third indicator portion produces a visible signal whenever the loop process value (1) is equal to the loop set point, (2) exceeds the loop set point by an amount less than the first amount, or (3) is less than the loop set point by an amount less than the second amount.

7 Claims, 4 Drawing Figures

CONTROLLER DEVIATION INDICATOR

BACKGROUND OF THE INVENTION

1. Field of the Invention

The present invention relates generally to display apparatus for indicating the deviation of process value from set point in a controlled process loop and more particularly to apparatus for providing scan-line type indication of such deviations for a plurality of controlled process loops.

2. Description of the Prior Art

An industrial process includes numerous process variables, such as pressures, temperatures, flow rates and levels, whose values are a function of the settings or dynamics of various control devices, such as valves and pumps. Proper performance of such a process requires that such process variables and/or the relationship (ratio, etc.) of such process variables to one another or to the other factors, such variable values and relationships being referred to as process values, be maintained at predetermined values, referred to as set points. Thus, such processes include process control systems in which the process variables are monitored so that the process values can be determined, such process values are compared to the appropriate set point, and the appropriate control devices are adjusted, such as by resetting a valve or the speed of a pump, to correct any deviation of such process values from set point.

In an automatic process control system, such control of process variable values is accomplished through one or more control loops. In a control loop, the values of one or more of the process variables (loop variables) are indicated as electrical signals (analog signals) generated by transducers associated with such variables and/or as contact closures or openings (discrete signals) generated by switches associated with such variables. These values are supplied to a controller as the loop data input. The controller, which ordinarily includes either an analog or a digital computer, is programmed to act on such loop data input in the appropriate fashion, including, if necessary, determining the relationship of one process variable to another or to a constant programmed into the computer, so as to determine the loop process value. This loop process value is then compared to the loop set point so as to determine the deviation between the loop process value and set point. The set point is stored in the controller either as a voltage level (in the case of an analog controller) or as a digital value in memory (in the case of a digital controller). The controller then provides one or more output signals in the form of a continuous electrical signal (analog output) and/or as contact openings and closures (discrete output). The controller is programmed in accordance with appropriate control strategy such that the output signals adjust the control devices associated with the loop variables so as to decrease the deviation between the loop process variable and the loop set point (loop deviation).

During ordinary operation, an automatic control system should be capable of controlling an extremely large process with a tremendous number of variables with essentially no human intervention; i.e., once the controllers for all the loops have been properly programmed to maintain the various loop process values at their respective loop set points, such programming being accomplished through a programming interface between each controller and a programmer, the controllers should be able to adjust the control devices to keep the loop deviations at approximately zero without further adjustment. In this regard, the dynamics of the process and control devices often make perfect control of the variables impossible; i.e., there will often be some deviation between each loop process value and the corresponding loop set point. As a result, a certain amount of deviation between a loop process value and a loop set point is acceptable. Thus, the control strategy for a loop is designed to keep the deviation for that loop within the acceptable limits without human intervention.

Certain conditions may arise, however, in which the controller of a loop is unable to maintain the loop deviation within acceptable limits. Such excessive loop deviation not only may prevent the process from operating optimally, but also may cause damage to the process and endanger the safety of the operators. Thus, most automatic control systems include an indicator interface for providing a visible indication of the various loop deviations. Such indicator interfaces are sometimes coupled with an alarm interface that provide special visible and/or audible signals whenever an alarm condition, which may be an excessive loop deviation, exists. By virtue of such interfaces, an operator is able to take extraordinary measures to correct the alarm condition.

A well-known indicator interface of the prior art has been the scan-line indicator. Such scan-line indicators have been used in conjunction with automatic control systems that have a large number of loops and include a separate analog controller for each loop. Each controller includes a fixed, horizontal, transparent, usually green, bar disposed over a scale that is adjustable with respect to such bar. The bar has an opaque, horizontal hairline extending along its axis, such line representing set point. The indicator interface of each controller further includes a horizontal, vertically movable pointer whose vertical position is a function of process value for the loop of the controller. When such loop process value is equal to the loop set point, the pointer of the controller indicator interface will be disposed either in front of or behind the bar of such interface in vertical alignment with the hairline of such bar. As the loop process value deviates from the loop set point, the pointer will move above or below the hairline, depending on the direction of deviation. The amount of spacing between the pointer and the hairline is dependent on the percentage of the loop deviation with respect to set point ("percentage of loop deviation"). Generally speaking, if the pointer is within the width of the bar, although spaced from the hairline, the percentage of the loop deviation can be regarded as small, but if the pointer is spaced above or below the bar, the percentage of loop deviation can be regarded as large.

By placing several of such controllers side-by-side such that the bars of the indicator interfaces of such controllers are aligned with one another, information pertaining to the loop deviation of several loops can be quickly observed by a horizontal scan of the bars of each controller. If the percentage of loop deviation of each controller is small, the needle of the indicator interface of each controller will be observed within the width of the green bars during such scan. If the percentage of loop deviation of one of the controllers is large, the observer will be alerted to such large deviation during the scan by the absence of the needle of the indicator interface of such controller from the width of the green bar of such interface.

While such prior art indicator interfaces are capable of apprising an observer that a percentage of loop deviation is large or small, they do not provide any readily observable information with regard to the significance of such deviation, e.g., they do not specifically indicate whether an alarm condition exists. In this regard, it should be noted that while, for some process variables, such as temperatures and flow rates, small deviations, e.g. two percent, are critical and may constitute an alarm condition, for other process variables, such as level, large deviation, e.g., 30 to 40 percent, are acceptable. As a result, the operator may either fail to timely acknowledge an alarm condition or unnecessarily react where no alarm conditions exists.

SUMMARY OF THE INVENTION

The present invention is a deviation indicator interface that provides scan-line type deviation indication that readily informs an observer, during a scan of the interface, of the existence or non-existence of a critical deviation that may constitute an alarm condition. In addition, the interface of the invention may be constructed in a manner that will quickly inform an observer, during a scan, that a loop deviation is approaching a critical value. The interface of the invention has particular application with a multi-loop controller; i.e., a single controller that is capable of controlling a plurality of loops.

The deviation indicator interface of the invention includes a plurality of deviation indicators, each deviation indicator providing an indication of the loop deviation of a single loop. Each deviation indicator includes a first, second and third indicator portion. The first indicator portion produces a visible signal whenever the loop process value exceeds the loop set point by at least a first amount, the first amount being adjustable. The second indicator portion produces a visible signal whenever the loop process value is less than the loop set point by at least a second amount, the second amount being adjustable. The third indicator portion produces a visible signal whenever the loop process value (1) is equal to the loop set point, (2) exceeds the loop set point by an amount less than the first amount, or (3) is less than the loop set point by an amount less than the second amount.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

The deviation indicator apparatus of the preferred embodiment of the invention provides optimum benefits when used in conjunction with a digital-computer based, multi-loop controller. Generally speaking, such a controller comprises six basic parts: (1) a power supply for supplying power to all the circuitry of the controller; (2) a microprocessor for performing the various programs of the controller; (3) memory for providing both permanent (pre-Programmed Read-Only-Memory) and temporary (Random-Access-Memory) storage of information, including data, and programs; (4) data I/O interfaces for receiving input data and transmitting output data from and to the controlled process, such I/O interfaces including appropriate A/D and D/A convertors; (5) communication I/O interfaces for permitting communication with other controllers and remote operator terminals; and (6) an operator interface for providing local information to an operator and permitting local operator configuration and adjustment of the controller. For the purposes of this description, the components of the controller other than the operator interface will sometimes be collectively referenced as the base unit, such terminology and collective reference being adopted solely for the purpose of facilitating the description of the best mode for carrying out the invention.

Figure 1:
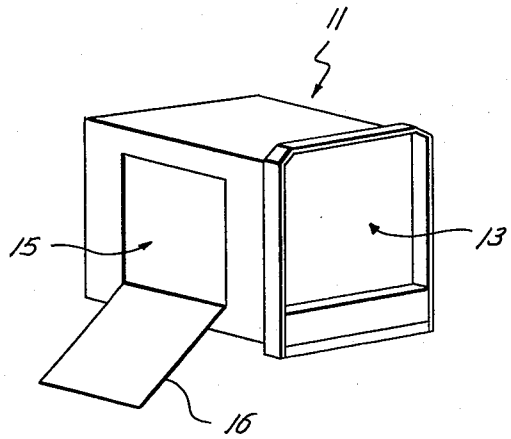
FIG. 1 is a pictorial representation of a digitial multi-loop controller in conjunction with which the deviation indicator interface of the invention can be used and illustrating the preferred location of the operator interface on the controller.

Referring to FIG. 1, a multi-loop digital controller is shown as including cabinet 11 in which the base unit is principally housed. The operator interface of the controller of FIG. 1 is shown as including front operator interface 13 and side operator interface 15. Generally speaking, front operator interface 13 includes displays, indicators and controls, some of which are described in greater detail, infra, that are monitored or operated, or may be monitored or operated, on a relatively regular basis during controlled operation of the process. Therefore, the controller should be positioned such that front operator interface 13 is readily observable by and accessible to an operator at all times, including all times that the process is operating under control of the controller. Also generally speaking, side operator interface 15 includes displays, indicators and controls, some of which are described in more detail infra, that are monitored and used on an irregular and ordinarily infrequent basis during controlled operation of the process. Therefore, side operators interface may be of limited accessibility and even secluded during the controlled operation of the process so that the controls of side operator interface 15 cannot be inadvertently operated during controlled operation. Such a goal can be fulfilled using cover panel 16 hingedly attached to cabinet 11. Furthermore, cabinet 11 may be drawer mounted with front operator interface 13 facing outwardly. Thus, by sliding cabinet 11 into the rack in which it is so mounted, side operator interface 15 can be secluded within the rack and by pulling cabinet 11 outwardly from such rack, side operator interface 15 can be accessed.

Figure 2:
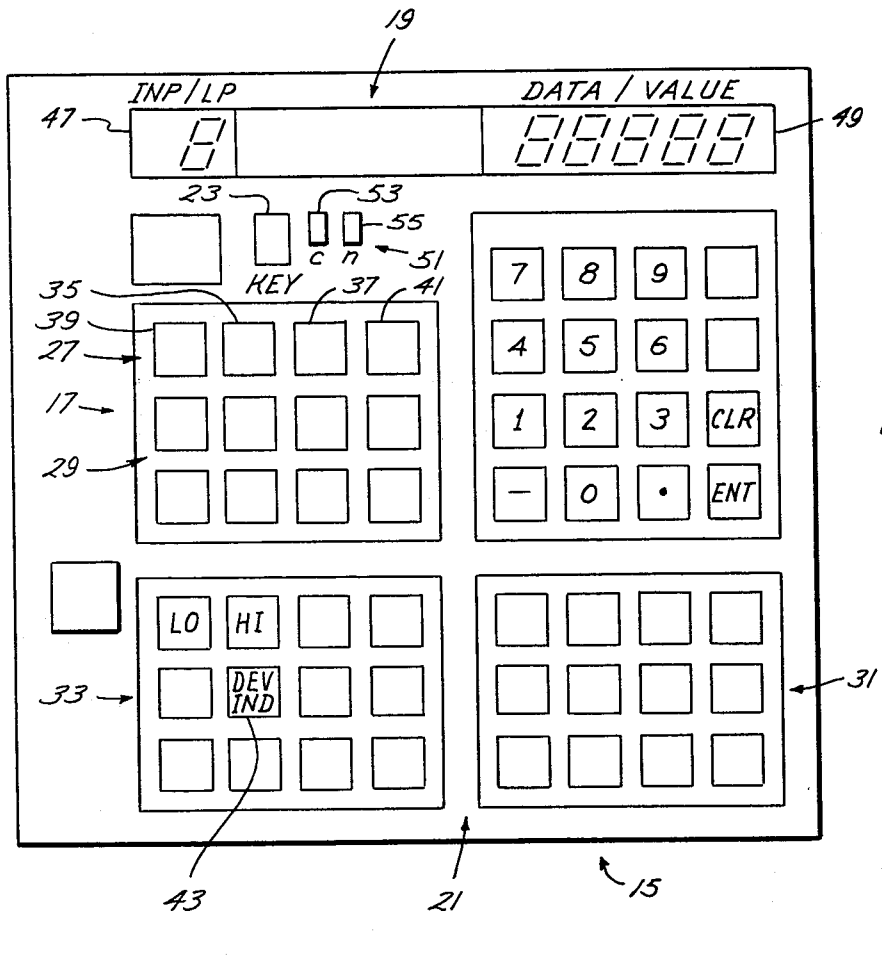
FIG. 2 is an elevation of a portion of the operator interface of a controller in conjunction with which the deviation indicator interface of the invention can be used and illustrating the interface for setting the values of the first and second amounts.

Referring to FIG. 2, side operator interface 15 includes control portion 17 and display portion 19 and provides a means for configuring the control strategy of the various loops into the base unit and for monitoring, on a detailed basis, the control strategy both before and after it is configured into the base unit.

Control portion 17 includes keyboard 21 and keyoperated switch 23 and constitutes the configuring means of side operator interface 15. Keyboard 21 is used to define the information to be supplied to or retrieved from the base unit and to control the supply of information to and the retrieval of information from the base unit. Switch 23 is used to disable keyboard 21 in order to prevent unauthorized entry of information into the base unit.

Keyboard 21 includes three basic types of keys: dedicated keys, data keys and control keys. The data keys are used to define numerical values. Thus, the data keys include a key for each of digits 0 through 9, a minus ("−") key and a decimal point (".") key. The dedicated keys, which are described in more detail infra, are used to define the action to be taken by the base unit, usually with respect to numerical values defined by operation of the data keys in conjunction with operation of one or more of the dedicated keys. The control keys are used to control the communication of the actions and/or numerical values defined by operation of the dedicated keys and/or data keys to the base unit. Thus, the control keys include an enter ("ENT") key and a clear ("CLR") key. Operation of the enter key results in communication of all information provided by operation of the dedicated keys and/or the data keys since the last operation of either the enter key or the clear key, whichever occurred last, to the base unit so that appropriate action on such information can be taken by the base unit. Operation of the clear key results in effective cancellation of all information provided by operation of the dedicated keys and/or the data keys since the last operation of the enter key so that such information, usually resulting from erroneous operation of one or more of the dedicated or data keys, will not be communicated to the base unit.

The dedicated keys include four basic groups of keys: general keys 27, routine configuration keys 29, tuning keys 31 and auxiliary data keys 33.

General keys 27 define actions that control the significance of the operation of the other groups of dedicated keys. Specifically, all the actions defined by such other groups of dedicated keys will relate either to a single loop or to a single input. Thus, prior to operation of such other groups of dedicated keys, the specific loop or input to which such operation applies must be defined. For this purpose, general keys 27 include loop key 35 for defining a particular loop and input key 37 for defining a particular input. In this regard, each loop and each input of a controller embodying the invention preferably is assigned a number. Thus, a particular loop can be selected by (1) depressing loop key 35; (2) using the data keys to key in the number assigned to such loop; and (3) depressing the enter key. A particular input is selected in a similar fashion with operation of input key 37 substituted for operation of loop key 35. After selection of a particular loop or input, all operation of the other groups of dedicated keys will relate to such loop or input until a different loop or input is selected.

For the purposes of this description, the multi-loop controller will be understood to have an eight-loop capability, each loop being distinctively assigned with one of the numbers 1 through 8. A particular controller embodying the invention may have a greater or lesser number of loops, but will always have a capability of more than one loop.

Furthermore, operation of routine configuration keys 29 requires interruption of control while operation of auxiliary data keys 33 does not. For this reason, general keys 27 further include routine configuration begin key 39 and auxiliary data entry key 41. Depression of auxiliary data entry key 41 prior to selection of a loop or input as described supra will set the base unit to receive information from auxiliary data keys 33 as described infra without interruption of control. Depression of routine configuration begin key 39 prior to selection of a loop or input as described supra sets the base unit to receive information from routine configuration keys 29 by interrupting control.

The actions defined by routine configuration keys 29 relate to the basic configuration routines of the various loops and inputs. The actions defined by tuning keys 31 relate to the parameters according to which adjustments in the control strategy for a particular loop are to be made in response to changes in the values of inputs and/or process variables. Thus, by operation of routine configuration keys 29 and/or tuning keys 31 following the selection of a particular input or loop, the basic control strategy for such input or loop can be programmed into the Random-Access-Memory of the controller. The specific actions defined by routine configuration keys 29 and tuning keys 31 may be any of a wide variety of functions related to control strategy and may vary from one controller to the next without affecting the operation of the present invention.

The actions defined by auxiliary data keys 33, although not part of the basic loop configuration routines, relate to the outputs and other variables involved in the various loops and include setting alarm values, calibrating scales for variables and setting output limits. Preferably, because the actions of auxiliary data keys 33 do not directly affect the basic loop configuration routines, operation of auxiliary data keys 33 neither requires nor results in control interruption. As with routine configuration keys 29 and tuning keys 31, the specific actions defined by the various keys of auxiliary data keys 33 may vary from one controller to the next. In a controller that includes the preferred embodiment of the invention, however, auxiliary data keys 33 will include a high level ("HI") key, a low level ("LO") key and one or more parameter keys. The pre-Programmed Read-Only-Memory of the base unit is programmed in conjunction with the microprocessor of the base unit such that, after depressing auxiliary data enter key 41 and selecting a particular loop or input as described supra, the value of a particular parameter for such loop or input can be set by (1) depressing the parameter key corresponding to such parameter; (2) using the data keys, keying in the desired value of such parameter; and (3) depressing the enter key. If the particular parameter is to have a high and a low value, such values are set by (1) depressing the parameter key corresponding to such parameter; (2) depressing the HI key; (3) keying in the desired high value for such parameter; (4) depressing the enter key; (5) depressing such parameter key again; (6) depressing the LO key; (7) keying in the desired low value for such parameter; and (8) depressing the enter key.

It should be noted that, in accordance with the foregoing means of entering the first and second amounts in the controller, the first and second amounts for a particular loop may differ from one another as well as from the first and second amounts for one or more of the other loops of the controller.

Furthermore, in a controller that includes the preferred embodiment of the invention, the parameter keys include deviation indicator limit key 43. Deviation indicator limit key 43 is used in conjunction with the HI and LO keys and general keys 27 to enter the deviations between set point and process value for each loop that constitutes an alarm condition. Specifically, if an alarm condition exists for a particular loop whenever the process value for such loop exceeds the set point for such loop by at least a first amount and whenever such loop process value is less than such set point by a second amount, such alarm condition parameters are programmed into the base unit by: (1) depressing auxiliary data entry key 41; (2) depressing loop key 35; (3) keying in the number assigned to such loop; (4) depressing the enter key; (5) depressing deviation indicator limit key 43; (6) depressing the HI key; (7) keying in the number corresponding to the first amount; (8) depressing the enter key; (9) depressing deviation indicator limit key 43; (10) depressing the LO key; (11) keying in the number corresponding to the second amount; and (12) depressing the enter key. Preferably, in a controller including the preferred embodiment of the deviation indicator interface of the invention, use of deviation indicator limit key 43 sets alarm limits only insofar as they affect such interface and does not affect alarm limits for other interfaces. In this way, the alarm limits for the deviation indicator interface may be set independently of those for other interfaces according to the dires of the programmer or user.

Display portion 19 provides a numerical indication of information supplied to, or to be supplied to, the base unit and a numerical indication of information retrieved from the base unit. Display portion 19 may further be used to guide an operator through the various programming steps. The particular arrangement of the displays and the types of information indicated by display portion 19 may vary widely. In a controller embodying the preferred embodiment of the invention, display portion 19 preferably includes loop number display 47, data display 49 and mode indicators 51. Loop number display 47 displays the number corresponding to the selected loop, if one is selected. Data display 49 displays the number keyed in using the data keys as they are being keyed in. In this way, the accuracy of such keying can be ascertained prior to communication of such number to the base unit, and erroneous keying can be corrected using the clear key. Mode indicators 51 includes routine configuring indicator 53 and auxiliary data enter indicator 55. Routine configuring indicator 53 indicates that the base unit is set to receive information from routine configuration keys 29 and illuminates upon depression of routine configuration begin key 39. Auxiliary data enter indicator 55 indicates that the base unit is set to receive information from auxiliary data keys 33 and illuminates upon depression of auxiliary data entry key 41. Preferably, indicators 53, 55 are different colors, indicator 53 being red, so that the operator is alerted when control is interrupted by operation of routine configuration begin key 39.

Figure 3:
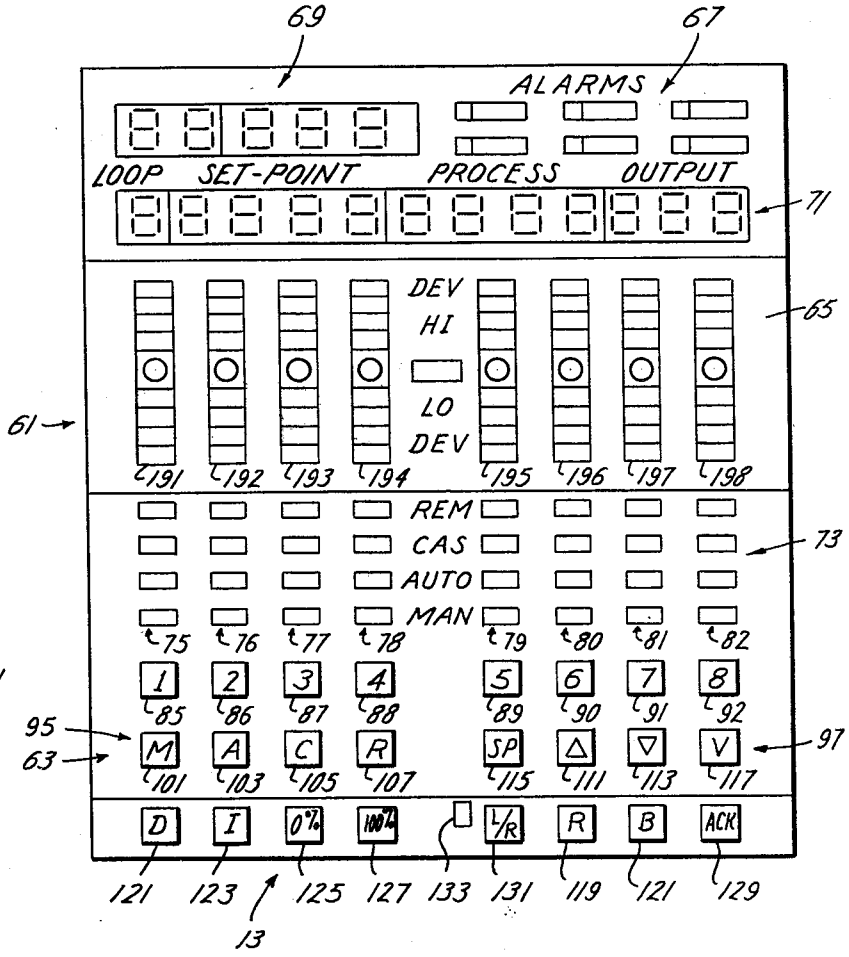
FIG. 3 is an elevation of another portion of the operator interface of a controller in conjunction with which the deviation indicator interface of the invention can be used, such interface including the deviation indicator interface of the preferred embodiment of the invention.

Referring to FIG. 3, front operator interface 13 of a controller embodying the invention includes display portion 61 and may further include control portion 63.

Deviation indicator interface 65, which constitutes the preferred embodiment of the present invention, is part of display portion 61 and will be described in greater detail infra. Display portion 61 may further include a variety of other indicators and/or displays such as (1) alarm indicators 67 having indicator lights associated with various labels for warning of impending trouble spots, the nature of the trouble being identified by the label associated with a flashing indicator light; (2) alarm-input display 69 which, when no alarm is indicated by alarm indicators 67, displays the value of and number of a particular input as selected by operation of control portion 63 as described infra, and, when an alarm is indicated by alarm indicators 67, displays the loop or input at which the alarm condition exists as well as the value of the alarm condition; (3) digital loop display 71 for displaying in digital format the loop number, loop set point, loop process value and loop output for a particular loop as selected by operation of control portion 63 as described infra; and (4) loop status indicators 73 for indicating, for each particular loop, the mode by which the output of the loop is controlled (e.g., manual control ("MAN") wherein the loop output is directly controlled by the operator through control portion 63; automatic control ("AUTO") wherein the loop output is a function of the loop control strategy and the loop set point as programmed into the base unit; cascade control ("CAS") wherein the loop output is a function of the loop control strategy and the loop set point as determined by the output of another loop; and remote control ("REM") wherein the output is controlled through a remote station). Preferably, loop status indicators 73 include indicator groups 75–82, corresponding to loops 1–8, respectively, arranged in a horizontal line across front operator interface 13. Each of indicator groups 75–82 corresponds to one of the loops of the controller and include four indicators, one of each control mode, arranged in a vertical column.

Similarly, control portion 63 may include any of a variety of controls that may be necessary for either regular adjustment of certain parameters or correction of alarm conditions. For example, as shown in FIG. 3, control portion 63 may include loop select pushbuttons 85–92 identified with and corresponding to the loop numbers 1 through 8, respectively, for selecting the loop whose various parameters are displayed by digital loop display 71, and/or whose parameters and/or control mode are to be altered by operation of one or more of the other controls, if any, of control portion 63. In this latter regard, control portion 63 may include mode selection controls 95 for selecting the control mode of a selected loop and parameter controls 97 for varying certain parameters of a selected loop. Thus, mode selection controls 95 may include four pushbuttons; (1) manual pushbutton 101 for setting the selected loop in manual control; (2) automatic pushbutton 103 for setting the selected loop in automatic control; (3) cascade pushbutton 105 for setting the selected loop in cascade control; and (4) remote pushbutton for setting the selected loop in remote control. Parameter controls 97 may include two functional types of momentary-action pushbuttons: (1) parameter select pushbuttons for selecting the parameter of the selected loop to be varied and (2) up/-down pushbuttons 111, 113 for decreasing and increasing, respectively, the value of the selected parameter. Preferably, in order to vary a parameter value, the appropriate up/down pushbutton should be depressed at the same time the appropriate parameter select pushbutton is depressed. The parameter select pushbuttons may include set point pushbutton 115 by which the set point of the selected loop can be increased or decreased, valve pushbutton 117 by which the output value of the selected loop can be increased or decreased, and ratio and bias pushbuttons 119, 121, respectively, by which the ratio and bias of a loop having a ratio control algorithm can be increased or decreased. If the parameter select pushbuttons includes valve pushbutton 117, such pushbutton preferably is enabled only when the selected loop is in manual control.

Where control portion 63 includes loop select pushbuttons 85–92, such pushbuttons preferably are arranged in a horizontal line and aligned beneath loop status indicator groups 75–82, respectively, such that the numbers on such pushbuttons identify the loop to which each such indicator group belongs.

Control portion 63 may further include input select pushbuttons 121, 123 for selecting the input whose value is displayed by alarm-input display 69 when no alarm condition exists; input range pushbuttons 125, 127 for displaying the range of the selected input and/or the total engineering value of the selected input on alarm-input display 69; alarm acknowledge pushbutton 129 for resetting a flashing alarm indication provided by one or more of alarm indicators 67; and local/remote pushbutton 131 for placing all loops of the controller in local operation, i.e., inhibiting remote operation of all the loops, in case of a communication malfunction or for some other reason. Preferably, pushbutton 131 has push-push action. LED indicator 133 serves to indicate that pushbutton 131 is in the local position.

Figure 4:
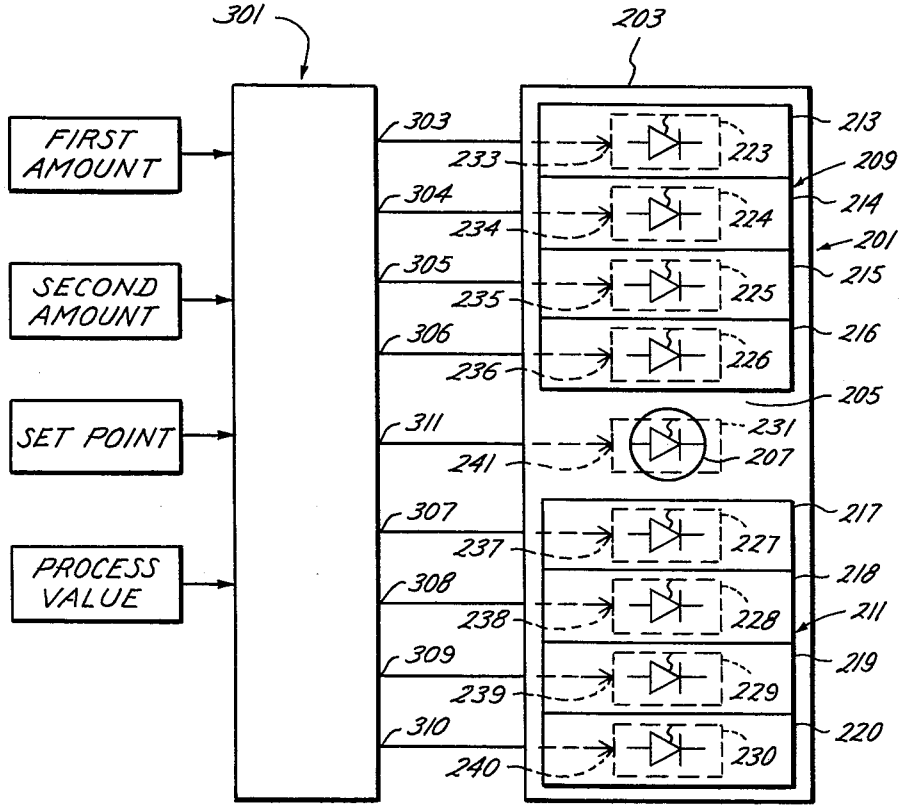
FIG. 4 is a partially block, partially pictorial drawing illustrating the general connection of a deviation indicator of the deviation indicator interface of the preferred embodiment of the invention to a deviation indicator control unit.

As shown in FIG. 3, deviation indicator interface 65 includes deviation indicators 191–198 for providing an indication of the loop deviation for loops 1–8, respectively. Referring to FIG. 4, each deviation indicator includes panel window 201. Panel window 201 has opaque outer boundary 203 having an elongate rectangular configuration with a vertically-oriented axis. Panel window 201 further has opaque horizontal bar 205 extending between the centers of the vertical sides of boundary 203. Bar 205 has translucent, green, circular window 207 at its geometrical center. Bar 205 together with boundary 203 define upper window portion 209 above bar 205 and lower window portion 211 below bar 205. Upper window portion 209 is divided into elongate, horizontally-oriented window subportions 213–216. Lower window portion is divided into elongate, horizontally-oriented window subportions 217–220. Window subportions 213–220 are translucent and have substantially identical size and configuration. Preferably, window subportion 213 at the uppermost end of upper window portion 209 and window subportion 220 at the lowermost end of lower window subportion 211 are tinted red, and window subportions 214–219 are all tinted yellow.

Each deviation indicator further includes LED circuits 223–231 having inputs 233–241, respectively. LED circuits 223–231 each includes a light-emitting diode ("LED") that is illuminated whenever a particular input signal, referred to herein as an "ON" signal, is supplied to the input of the LED circuit. The LED of LED circuits 223–230 are positioned directly behind window subportions 213–220, respectively, such that when one of such LEDs is illuminated, the window subportion directly in front of such LED is illuminated and none of the remaining parts of window 201 is illuminated. The LED of LED circuit 231 is positioned directly behind window 207 such that when the LED of LED circuit 231 is illuminated, window 207 is illuminated and none of the remaining parts of window 201 is illuminated.

Referring again to FIG. 3, deviation indicators 201–208 are disposed on front operator interface 13 such that the vertical axes of windows 201 of deviation indicators 191–198 are aligned vertically above loop select pushbuttons 85–92, respectively, and such that the corresponding window subportions of windows 201 are arranged along a horizontal line. In this way, the loop to which a particular deviation indicator window 201 corresponds can be identified by the number of the loop select pushbutton positioned vertically beneath such deviation indicator window. Furthermore, all the deviation indicator windows can be readily monitored by a horizontal scan.

The supply of "ON" signals to the LEDs of the various LED circuits of deviation indicators 191–198 is controlled by the base unit. Generally speaking, for each of indicators 191–198, the base unit includes a deviation indicator control module 301 (See FIG. 4) for each of deviation indicators 191–198. Module 301 may include portions of both the pre-Programmed Read-Only-Memory and the Random-Access-Memory and operation of module 301 may be controlled by the microprocessor. As indicated in FIG. 4, module 301 is supplied with the HI and LO deviation indicator limits, i.e., the first and second amounts, for the loop to which module 301 corresponds as programmed into the base unit as indicated supra and with the set point and process values for such loop. Module 301 has outputs 303–311 connected to inputs 233–241, respectively of the deviation indicator corresponding to such loops. The configuration of module 301 is such that, at a particular point in time, one, and only one, of outputs 303–311 will supply an ON signal to the LED input circuit to which it is connected, the particular one of outputs 303–311 supplying such ON signal at such point in time being a function of the information supplied to module 301 at such point in time; i.e., the first and second amounts, the process value and set point for the loop to which such module 301 corresponds. In order to facilitate the description of such function, the deviation existing when the process value of a loop exceeds the set point of such loop will be referred to as a "positive deviation" for such loop, and the deviation existing when the process value of a loop is less than the set point of such loop will be referred to as a "negative deviation" for such loop. In accordance with such definitions, (1) output 303 will supply an ON signal to input 233 of LED circuit 223 whenever, and only when, a positive loop deviation equal to or greater than the first amount exists; (2) output 304 will supply an ON signal to input 234 of LED circuit 224 whenever, and only when, a positive deviation less than the first amount but equal to or greater than 70% of the first amount exists; (3) output 305 will supply an ON signal to input 235 of LED circuit 225 whenever, and only when, a positive deviation less than 70% of the first amount but equal to or greater than 40% of the first amount exists; (4) output 306 will supply an ON signal to input 236 of LED circuit 226 whenever, and only when, a positive deviation less than 40% of the first amount but equal to or greater than 10% of the first amount exists; (5) output 307 will supply an ON signal to input 237 of LED circuit 227 whenever, and only when, a negative deviation less than 40% of the second amount but equal to or greater than 10% of the second amount exists; (6) output 308 will supply an ON signal to input 238 of LED circuit 228 whenever, and only when, a negative deviation less than 70% of the second amount but equal to or greater than 40% of the second amount exists; (7) output 309 will supply an ON signal to input 239 of LED circuit 229 whenever, and only when, a negative deviation less than the second amount but equal to or greater than 70% of the second amount exists; (8) output 310 will supply an ON signal to input 240 of LED circuit 230 whenever, and only when, a negative deviation equal to or greater than the second amount exists; and (9) output 311 will supply an ON signal to input 241 of LED circuit 231 when, and only when the loop process value equals the loop set point or a positive deviation less than the first amount exists or a negative deviation less than the second amount exists.

Thus, whenever there is a positive deviation greater than the HI deviation indicator limit for a particular loop, red window subportion 213 at the top of the panel window 201 corresponding to such loop will be illuminated. Similarly, whenever there is a negative deviation greater than the LO deviation indicator limit for a particular loop, red window subportion 220 at the bottom of the panel window 201 corresponding to such loop will be illuminated. For all other loop deviations of a particular loop, including a deviation of zero, one of yellow subportions 214–219 or circular window 207 will be illuminated. More specifically, whenever, for a particular loop, there is a positive deviation equal to or greater than 10% of the HI deviation indicator limit but less than the HI deviation indicator limit, one of yellow window subportions 214–216 disposed below red window subportion 213 and above circular window 207 of the panel window 201 corresponding to such loop will be illuminated; whenever, for a particular loop, there is a negative deviation equal to or greater than 10% of the LO deviation indicator limit, one of yellow window subportions 217–219 disposed below circular window 207 and above red window subportion 220 of the panel window 201 corresponding to such loop will be illuminated; and whenever, for a particular loop, there is no deviation or there is a positive deviation less than 10% of the HI deviation indicator limit or there is a negative deviation less than 10% of the LO deviation indicator limit, circular window 207 at the center of the panel window 201 corresponding to such loop will be illuminated. With regard to positive deviations equal to or greater than 10% of the HI deviation indicator limit but less than the HI deviation indicator limit, the particular one of yellow window subportions 214–216 that will be limited will depend on the amount of such positive deviation, the uppermost of window subportions 214–216, i.e., subportion 214, being illuminated when the positive deviation is less than the HI deviation indicator limit but greater than or equal to 70% of such limit, the lowermost of window subportions 214–216, i.e., subportion 216, being illuminated when the positive deviation is less than 40% of such limit but greater than or equal to 10% of such limit, and the intermediate of such window subportions, i.e., subportion 215, being illuminated when the positive deviation is less than 70% of such limit but greater than or equal to 40% of such limit. With regard to negative deviations equal to or greater than 10% of the LO deviation indicator limit but less than the LO deviation indicator limit, the particular one of yellow window subportions 217–219 that will be illuminated will depend on the amount of such negative deviation, the lowermost of window subportions 217–219, i.e., subportion 219, being illuminated when the negative deviation is less than the LO deviation indicator limit but greater than or equal to 70% of such limit, the lowermost of window subportions 217–219, i.e., subportion 217, being illuminated when the negative deviation is less than 40% of such limit but greater than or equal to 10% of such limit, and the intermediate of such window subportions, i.e., subportion 218, being illuminated when the negative deviation is less than 70% of such limit but greater than or equal to 40% of such limit. Thus, where a yellow window subportion of a particular deviation indicator is illuminated, the farther such yellow window subportion is from the center of such deviation indicator, the greater the deviation for the loop corresponding to such deviation indicator.

In accordance with the foregoing, a quick-horizontal eye-scan of the deviation indicators of deviation indicator interface 65 will apprise an operator or observer of substantial information relating to the deviations of each of the loops controlled by the controller. For example, if the scan reveals nothing but green lights at the center of each deviation indicator of such interface, the observer is appraised that all loops are properly on control and that, most likely, there is no potential alarm condition due to a loop deviation. The accuracy of such information is heightened because each green light indicates that any deviation that exists is less than 10% of a deviation that constitutes an actual alarm condition, regardless of the fact that the deviation constituting an alarm condition may be different for each loop controlled by the controller and regardless of the fact that the positive deviation constituting an alarm condition for a particular loop may be different from the negative deviation constituting an alarm condition for such loop. If such scan reveals one or more yellow lights, but no red lights, the observer is informed that one or more loops is somewhat off control, but that no alarm condition due to excessive loop deviation exists for the loops of such controller. In this way, the observer is alerted to the existence of a potential alarm condition. Furthermore, the extent of such the deviation indicated by a yellow light is indicated by the distance of such yellow light from the center of the panel window, the greater such distance, the greater the deviation. Again, such information is reliable with respect to the non-existence of alarm conditions even though the deviations constituting an alarm condition for each loop of the controller may differ for one or more of such loops. If such scan reveals one or more red lights, the observer is immediately and accurately informed of the existence of an actual alarm condition. The observer may then take whatever steps and measures are necessary to correct or alleviate such condition.

Although the deviation indicator interface described in detail supra has been found to be most satisfactory and preferred, many variations in structure are possible without departing from the spirit of the invention. For example, the number of window subportions may be increased or decreased and the percentages of the deviations to which illumination of the various window subportions correspond may vary from one embodiment to the next. Also, a rectangular window having a configuration similar to the window subportions, or a window of another configuration, may be substituted for the circular window. Furthermore, other colors may be used to tint the circular windows and/or the various window subportions. In addition, the number of deviation indicators included in the deviation indicator interface may be increased or decreased.

Because many varying and different embodiments may be made within the scope of the inventive concept herein taught and because many modifications may be made in the embodiment herein detailed in accordance with the descriptive requirements of the law, it should be understood that the details herein are to be interpreted as illustrative and not in a limiting sense.

What is claimed as invention is:

1. A deviation indicator interface for simultaneously providing the deviation of the process value from the set point for each loop of a multi-loop controller, such deviation indicator interface comprising:

a plurality of deviation indicators, each deviation indicator corresponding to one of the loops of such controller, the deviation indicator for each particular loop including (1) a first indicating means for providing a visible signal whenever the process value of such loop is greater than the set point of such loop by at least a first amount, (2) a second indicating means for providing a visible signal whenever the process value of such loop is less than the set point of such loop by at least a second amount, and (3) a third indicating means for providing a visible signal whenever the process value of such loop is equal to the set point of such loop is greater than the set point of such loop by an amount less than said first amount or is less than the set point of such loop by an amount less than said second amount, the first and second amounts for each deviation indicator being independently adjustable.

2. The deviation indicator interface of claim 1 wherein the first and second amounts of each deviation indicator correspond to deviation alarm limits for the loop to which such deviation indicator corresponds.

3. The deviation indicator interface of claim 1 wherein said first indicating means of each deviation indicator includes a first light source, said second indicating means of each deviation indicator includes a second light source; and said third indicating means of each deviation indicator includes a third light source, the first, second and third light sources of each deviation indicator being arranged in a substantially-vertical, substantially-straight line.

4. The deviation indicator interface of claim 3 wherein the first light source of each deviation indicator is positioned above the second light source of such deviation indicator and the third light source of such deviation indicator is positioned intermediate the first and second light sources of such deviation indicator.

5. The deviation indicator interface of claim 3 wherein the first lights of the deviation indicators are arranged in a substantially horizontal first line, the second lights of the deviation indicators are arranged in a substantially horizontal second line, and the third lights of the deviation indicators are arranged in a substantially horizontal third line.

6. The deviation indicator interface of claim 5 wherein said first line is positioned above and parallel to said second line and said third line is positioned intermediate and parallel to said first and second lines.

7. A display apparatus for simultaneously providing and deviation of the process value from the set point for each loop of a multi-loop controller, such display apparatus comprising:

a plurality of deviation indicators, each deviation indicator corresponding to one of the loops of such controller, the deviation indicator for each particular loop including (1) a first indicating means for providing a visible signal whenever the process value of such loop is greater than the set point of such loop by at least a first amount, (2) a second indicating means for providing a visible signal whenever the process value of such loop is less than the set point of such loop by at least a second amount, and (3) a third indicating means for providing a visible signal whenever the process value of such loop is equal to the set point of such loop or is greater than the set point of such loop by an amount less than said first amount or is less than the set point of such loop by an amount less than said second amount, the first and second amounts for each deviation indicator being independently adjustable; and means for adjusting the first and second amounts for each deviation indicator.

* * * * *

UNITED STATES PATENT AND TRADEMARK OFFICE

CERTIFICATE OF CORRECTION

PATENT NO. : 4,254,412

DATED : March 3, 1981

INVENTOR(S) : Mauro G. Togneri

It is certified that error appears in the above—identified patent and that said Letters Patent is hereby corrected as shown below:

| | | |
|---|---|---|
| Column 4, | line 56, | change "Operators" to -- operator --. |
| Column 5, | lines 7-8, | change "keyoperated" to -- key-operated --. |
| Column 8, | line 37, | change "of" to -- for --. |
| Column 8, | line 54, | after "pushbuttons", change the semicolon ";" to a colon -- : --. |
| Column 8, | line 63, | delete the hyphen at the end of the line. |
| Column 11, | line 51, | change "limited" to -- illuminated --. |
| Column 13, | line 27, | after "set point of such loop" insert -- or --. |
| Column 13, | line 35, | change "of" to -- for --. |
| Column 14, | line 21, | change "and" to -- the --. |

Signed and Sealed this

*Fifth* Day of *January 1982*

[SEAL]

*Attest:*

GERALD J. MOSSINGHOFF

*Attesting Officer*

*Commissioner of Patents and Trademarks*